US008790190B2

(12) United States Patent
Kamnikar et al.

(10) Patent No.: US 8,790,190 B2
(45) **Date of Patent: *Jul. 29, 2014**

(54) GOLF TRAINING AID

(71) Applicant: Joseph A. Kamnikar, Sewickley, PA (US)

(72) Inventors: Joseph A. Kamnikar, Sewickley, PA (US); Lyle Chamberlain, Pittsburgh, PA (US)

(73) Assignee: Joseph A. Kamnikar, Sewickley, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/912,737

(22) Filed: Jun. 7, 2013

(65) Prior Publication Data

US 2013/0274026 A1 Oct. 17, 2013

Related U.S. Application Data

(63) Continuation of application No. 13/091,706, filed on Apr. 21, 2011, now Pat. No. 8,465,377.

(60) Provisional application No. 61/326,889, filed on Apr. 22, 2010.

(51) Int. Cl.
*A63B 69/36* (2006.01)

(52) U.S. Cl.
USPC ..... 473/266; 473/268; 473/278; 473/409

(58) Field of Classification Search
USPC ..... 473/199, 266, 268, 278, 409
See application file for complete search history.

(56) References Cited

U.S. PATENT DOCUMENTS

| | | | |
|---|---|---|---|
| 3,622,159 | A | 11/1971 | Morton |
| 3,894,739 | A | 7/1975 | Goldstein |
| 4,000,904 | A | 1/1977 | Poortman |
| 4,139,198 | A | 2/1979 | Kanavas |
| 4,180,270 | A | 12/1979 | Long |
| 4,508,339 | A | 4/1985 | Llewellyn |
| 4,819,937 | A | 4/1989 | Gordon |
| 4,822,042 | A | 4/1989 | Landsman |
| 4,834,375 | A | 5/1989 | Elstein et al. |
| 5,031,909 | A | 7/1991 | Pecker |
| 5,080,362 | A | 1/1992 | Lillard |
| 5,100,134 | A | 3/1992 | Becker |
| 5,380,001 | A | 1/1995 | Socci et al. |
| 5,428,846 | A | 7/1995 | Socci et al. |

(Continued)

FOREIGN PATENT DOCUMENTS

WO 97/04839 A1 2/1997

*Primary Examiner* — Raleigh W Chiu
(74) *Attorney, Agent, or Firm* — The Webb Law Firm

(57) ABSTRACT

A golf training device may include a base having a top surface and an opposing bottom surface for placing on a surface; a ball positioning sensor positioned adjacent to the top surface; and a light source for transmitting visible light from the base, the light source being in operable communication with the ball positioning sensor to respond to a signal from the ball positioning sensor that a ball has been moved from a resting position to transmit light for a finite predetermined period of time after the ball is moved from the resting position. A method of training may include receiving a ball on a training device in a resting position; detecting the presence of the ball on the top surface; detecting that the ball has been moved; transmitting light from a light source for a predetermined period of time in response to detecting that the ball has been moved.

20 Claims, 10 Drawing Sheets

(56) References Cited

U.S. PATENT DOCUMENTS

| | | | |
|---|---|---|---|
| 5,447,305 | A | 9/1995 | Socci et al. |
| 5,467,992 | A | 11/1995 | Harkness |
| 5,472,205 | A | 12/1995 | Bouton |
| 5,538,250 | A | 7/1996 | Putz |
| 5,692,965 | A | 12/1997 | Nighan, Jr. et al. |
| 5,746,663 | A | 5/1998 | Calace |
| 5,800,278 | A | 9/1998 | Varriano |
| 5,976,037 | A | 11/1999 | Watson |
| 6,146,289 | A | 11/2000 | Miller et al. |
| 6,238,307 | B1 | 5/2001 | Owen |
| 6,458,040 | B1 | 10/2002 | Veazie, III |
| 6,514,151 | B2 | 2/2003 | Delaplane |
| 6,702,690 | B1 | 3/2004 | Albright |
| 6,821,211 | B2 | 11/2004 | Otten et al. |
| 7,134,966 | B1 | 11/2006 | Tice |
| 7,169,067 | B2 | 1/2007 | Town |
| 7,513,833 | B1 | 4/2009 | Town |
| 8,287,398 | B2 | 10/2012 | Nusbaum et al. |
| 2001/0017347 | A1 | 8/2001 | Blankenship |
| 2002/0183567 | A1 | 12/2002 | Fenouil et al. |
| 2003/0036446 | A1 | 2/2003 | Udwin et al. |
| 2003/0054898 | A1 | 3/2003 | Otten et al. |
| 2003/0104874 | A1 | 6/2003 | Galanis et al. |
| 2003/0153394 | A1 | 8/2003 | Chen |
| 2004/0192459 | A1 | 9/2004 | Gustine |
| 2005/0107180 | A1 | 5/2005 | Halleck et al. |
| 2010/0317448 | A1 | 12/2010 | Leonard |
| 2012/0040768 | A1 | 2/2012 | Allen et al. |

GOLF TRAINING AID

CROSS REFERENCE TO RELATED APPLICATIONS

This application is a continuation application of U.S. patent application Ser. No. 13/091,706 filed Apr. 21, 2011, entitled "Golf Putting Training Aid", which claims priority to U.S. Provisional Patent Application Ser. No. 61/326,889, filed Apr. 22, 2010, entitled "Golf Putting Training Aid", the entire disclosures of both of which are hereby incorporated by reference in their entireties.

BACKGROUND OF THE INVENTION

1. Field of the Invention

This invention relates to golf training aids and, more particularly, to putting training aids for maintaining head position after ball impact.

2. Description of Related Art

Golf is a recreational sport that is very popular throughout the world. Golfers spend large amounts of money on new clubs, balls, and training aids in an attempt to improve their games.

Many available training aids are very complicated and require golfers to change or manipulate their natural swings. Some training aids are just impractical because they are too large and cumbersome to be taken to golf courses and practice facilities. Many of these training aids are just too expensive and do not work.

Putting and short game comprises a majority of the shots taken during an average round of golf. Therefore, an inexpensive and effective putting training aid would be invaluable to improving a golfer's score.

One of the most important concepts in putting is maintaining your head in a down position throughout the entire putting stroke in order to move the putter and hands down the target line. Many golfers have a tendency to pick their heads up too soon or immediately after a putting stroke. They are anxious to see if the ball is on the correct path towards the hole immediately after the ball leaves the putter face. "Peaking" may be the largest problem among golfers' putting games and can result in drastically higher scores. If the eyes move, the head moves, and the upper body follows, throwing the stroke off line, which leads to poor contact. Plus, if the golfer is distracted by thoughts of where the ball is going, focus is taken off the task of keeping the putter and hands moving directly down the target line. Simply put, a golfer that picks up his or her head will not contact the ball properly, thereby resulting in off-line putts, poor distance control, and higher scores.

Examples of some training aids are disclosed in U.S. Pat. Nos. 7,169,067 and 7,513,833. These devices are optimized to teach hand-eye coordination for impacting an object and "keeping your eye on the ball". The devices disclosed in these two patents utilize a plurality of colored lights to indicate whether a golfer and/or a batter has kept their eyes on the ball by flashing one of a plurality of colored lights for only fractions of a second, wherein if a golfer or batter has kept his or her eyes on the ball, he or she will be able to recognize the color of the light that was flashed. That same colored light is flashed a second time after a period of time so that the user can confirm the color he or she saw. However, the devices disclosed in these patents fail to consider the specifics of the putting stroke. The devices of these patents are optimized for a full swing by a bat or golf club. The full swing nature of these devices requires the presence of a cylindrical tee on them.

The slower, shorter putting stroke requires a golfer to maintain his or her head position for much longer than a fraction of a second so that the golfer can maintain the putter head moving down the target line. If a golfer picks up his or her head after only a fraction of a second, the putting stroke will be moved off line. The golf swing device disclosed in U.S. Pat. No. 7,513,833 utilizes a non-ball focal point for placement of the lights. The device of U.S. Pat. No. 7,513,833 requires the user to focus on three different points away from the golf ball to maintain eye contact away from the ball during a golf club swing. This is completely contrary to popular and established putting technique, which requires the golfer to maintain focus on the ball itself and its starting position even after impact. Further, putting requires an unobstructed, smooth path for a golf ball to roll towards a target. The devices disclosed in the above patents fail to consider this and, therefore, do not permit a practicing golfer to obtain a true representation of a putting stroke.

SUMMARY OF THE INVENTION

An embodiment of a golf training device may include a base having a top surface and an opposing bottom surface for placing on a surface; a ball positioning sensor positioned adjacent to the top surface; and a light source for transmitting visible light from the base, the light source being in operable communication with the ball positioning sensor to respond to a signal from the ball positioning sensor that a ball has been moved from a resting position to transmit light for a finite predetermined period of time after the ball is moved from the resting position. The top surface may include a ball receiving portion, wherein the ball positioning sensor is positioned adjacent to the ball receiving portion, and wherein the light source responds to a signal from the ball positioning sensor that the ball has been moved from the ball receiving portion to transmit the light for a finite predetermined period of time after the ball is moved from the resting position. The ball receiving portion may define a ball receiving recess. The light source may include a plurality of lights and/or may be adapted to transmit visible light in a pattern corresponding to the resting position of the ball. Further, the light source may be adapted to transmit visible light in pattern around the ball and/or may be arranged in a circular pattern. The circular pattern may define a diameter, such that when a ball is received within the ball receiving recess, the light source is not visible from the user's perspective. The light source may also be arranged around the ball receiving portion. The light source transmits light from the top portion of the base, and the transmission of light from the light source for a finite predetermined period of time may be a series of flashes. The top surface of the base may include at least a portion tapered to the surface, such that when the ball is moved from the resting position, the ball transitions from the tapered portion to the surface.

An embodiment of a method of training may include the steps of: receiving a ball on a top surface of a training device in a resting position; detecting the presence of the ball on the top surface of the training device; detecting that the ball has been moved from the resting position; transmitting light from a light source visible from the training device for a predetermined period of time in response to detecting that the ball has been moved from the resting position; and ceasing to transmit light after the predetermined period of time has lapsed. The light could be transmitted from a light source visible from the top surface of the training device for a predetermined period of time in response to detecting that the ball has been moved from the resting position. The detecting steps may include detecting via a ball positioning sensor. The step of transmitting light may include initiating a series of light flashes for the predetermined period of time. Further, a user may impact the ball from the resting position to move the ball from the resting position, and may maintain focus on the transmitted light for the predetermined period of time. Transmitting light from the light source may include transmitting light in a pattern corresponding to the resting position of the ball and/or may include transmitting the light around the ball. The light could be transmitted in a circular pattern.

Further details and advantages of the invention will become clear from the following detailed description when read in conjunction with the accompanying drawings.

DESCRIPTION OF THE PREFERRED EMBODIMENTS

Figure 1:
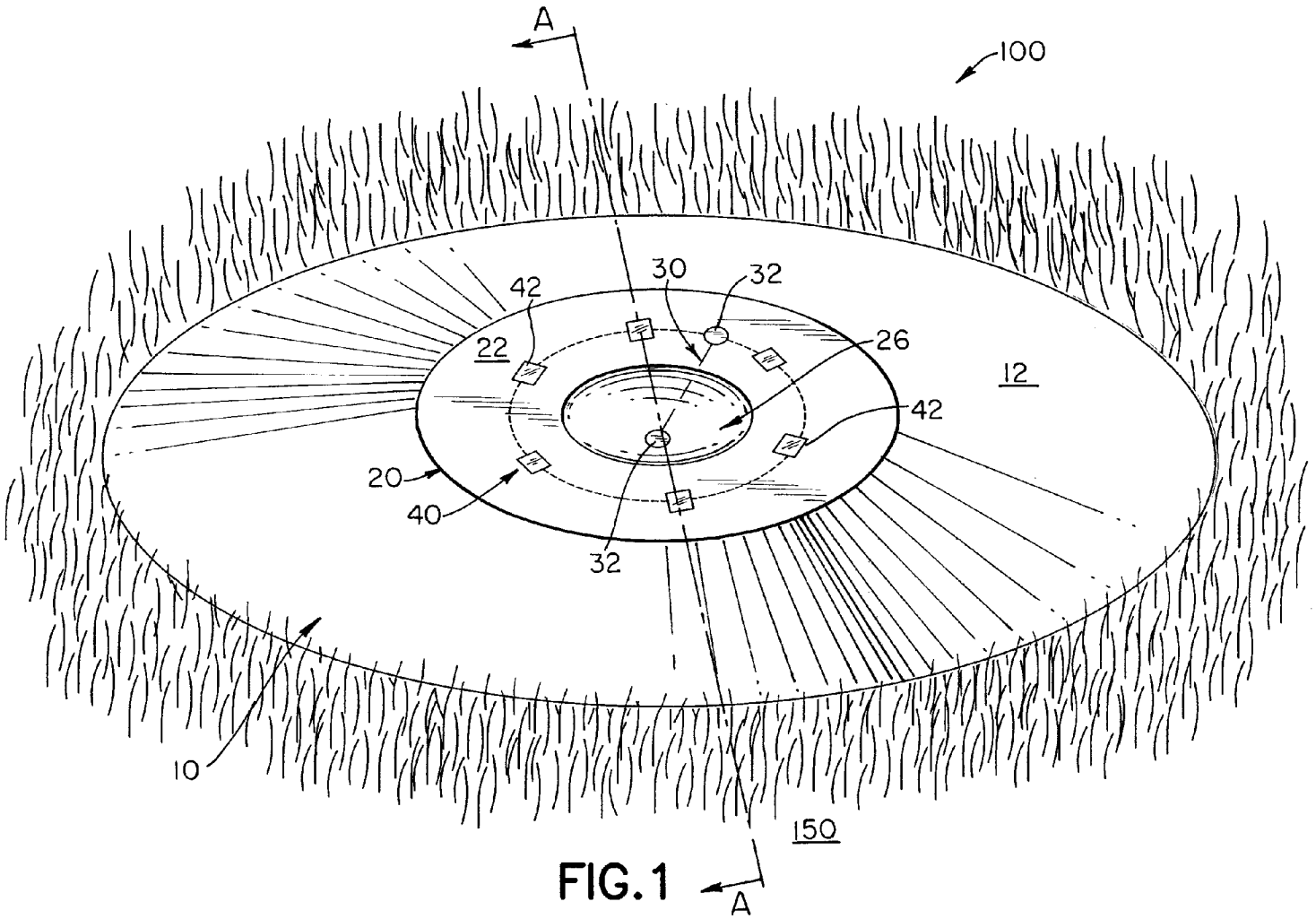
FIG. 1 is a perspective view of an embodiment of a putting training aid according to the present invention.

For purposes of the description hereinafter, the words "upper", "lower", "right", "left", "vertical", "horizontal", "top", "bottom", "lateral", "longitudinal" and like spatial terms, if used, shall relate to the described embodiments as oriented in the drawing figures. However, it is to be understood that many alternative variations and embodiments may be assumed except where expressly specified to the contrary. It is also to be understood that the specific devices and embodiments illustrated in the accompanying drawings and described herein are simply exemplary embodiments of the invention.

As shown in FIGS. 1-9, according to one embodiment of the present invention, a putting trainer 100 is depicted. Generally speaking, the putting trainer 100 includes a light source for emitting a pattern of visible on the top surface of the base 10, and a ball positioning sensor for detecting when a ball is impacted from the base 10, so as to trigger the light source for emitting the pattern of light, as will be described in detail herein.

Figure 7:
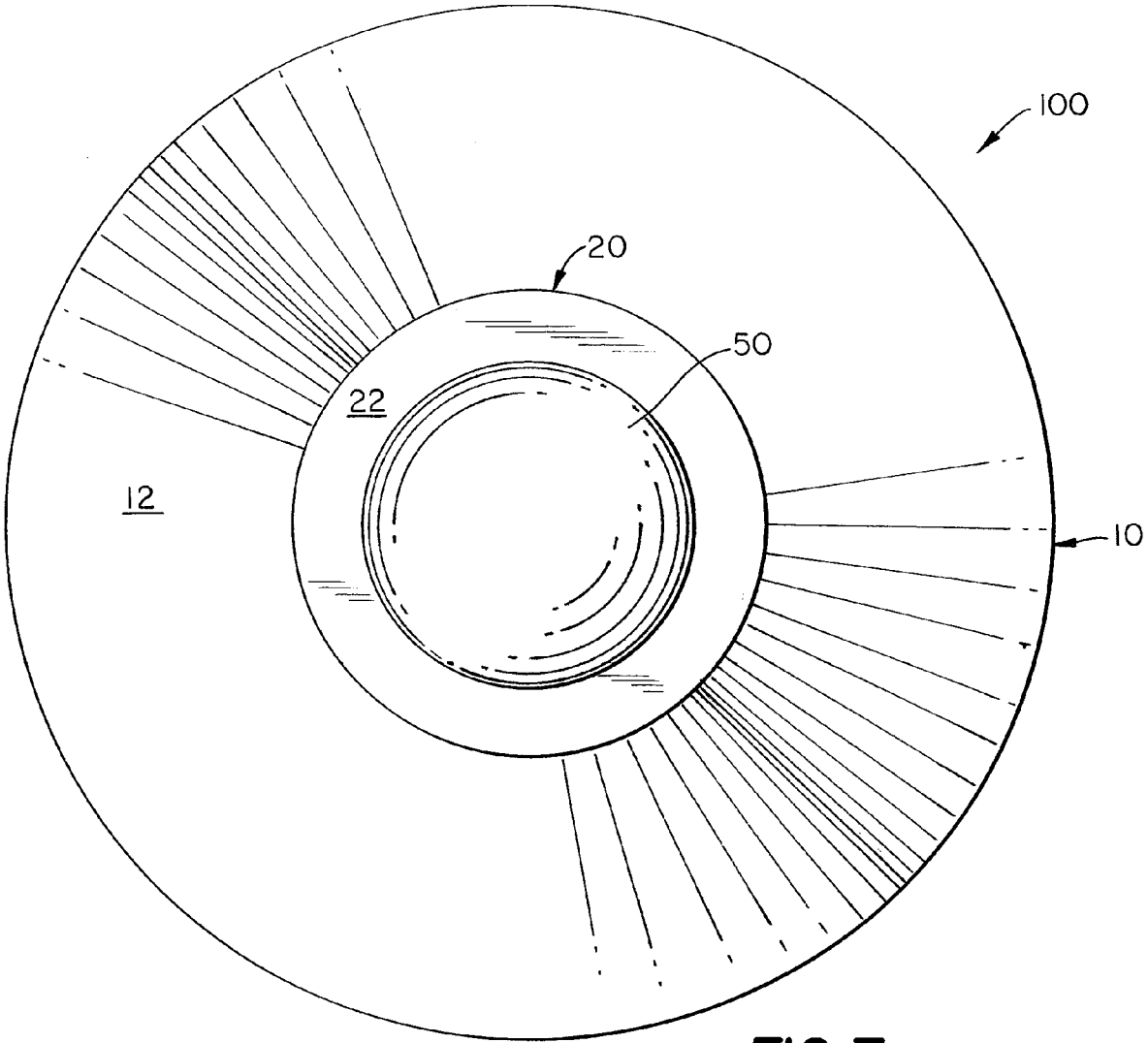
FIG. 7 is a top view of the view of FIG. 2.
Figure 8:
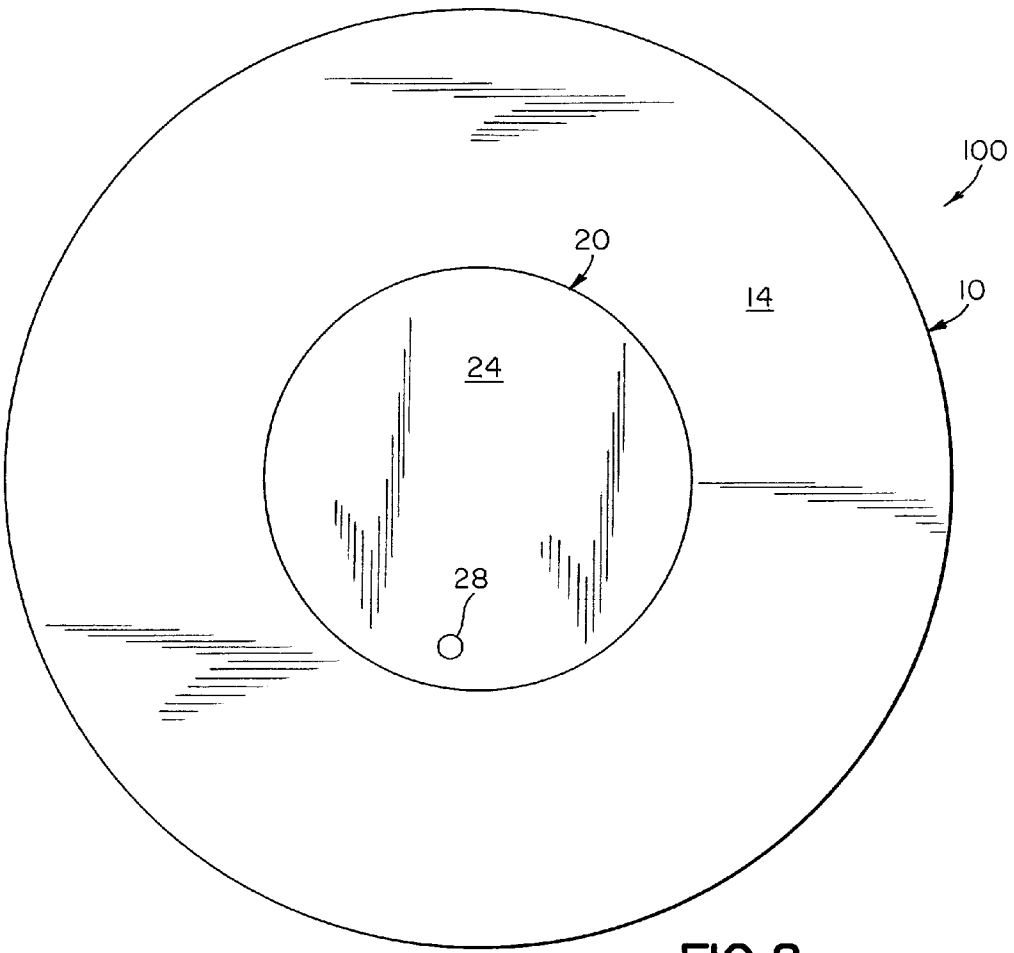
FIG. 8 is a bottom view of the putting training aid of FIG. 1.

The putting trainer 100 includes a base 10 having an inclined or tapered top or top surface 12 and a bottom surface 14 for placing on a putting surface. The putting surface can be any surface in which a golfer can putt and/or practice putting, such as a ground surface, carpet, or a practice green. The top surface 12 is tapered to a point wherein top surface 12 meets a putting surface, such as ground 150, at the bottom surface 14. As shown, the base 10 may be circular, wherein the tapering of top surface 12 causes the base 10 to take on a sloped form, as best shown in FIGS. 7 and 8. In the embodiments shown, at least a portion of the top surface 12 tapers to the putting surface about the entire perimeter of the base 10. The tapered top surface 12 is designed to allow a ball 50, such as a golf ball, positioned on the base 10, to smoothly roll from the top surface 12 to the ground or other surface on which the base 10 is resting. Further, tapered top surface 12 allows a user to smoothly roll a ball 50 from the ground or other surface base 10 without having to bend over to pick up and manually place the ball 50 on the base 10.

Figure 2:
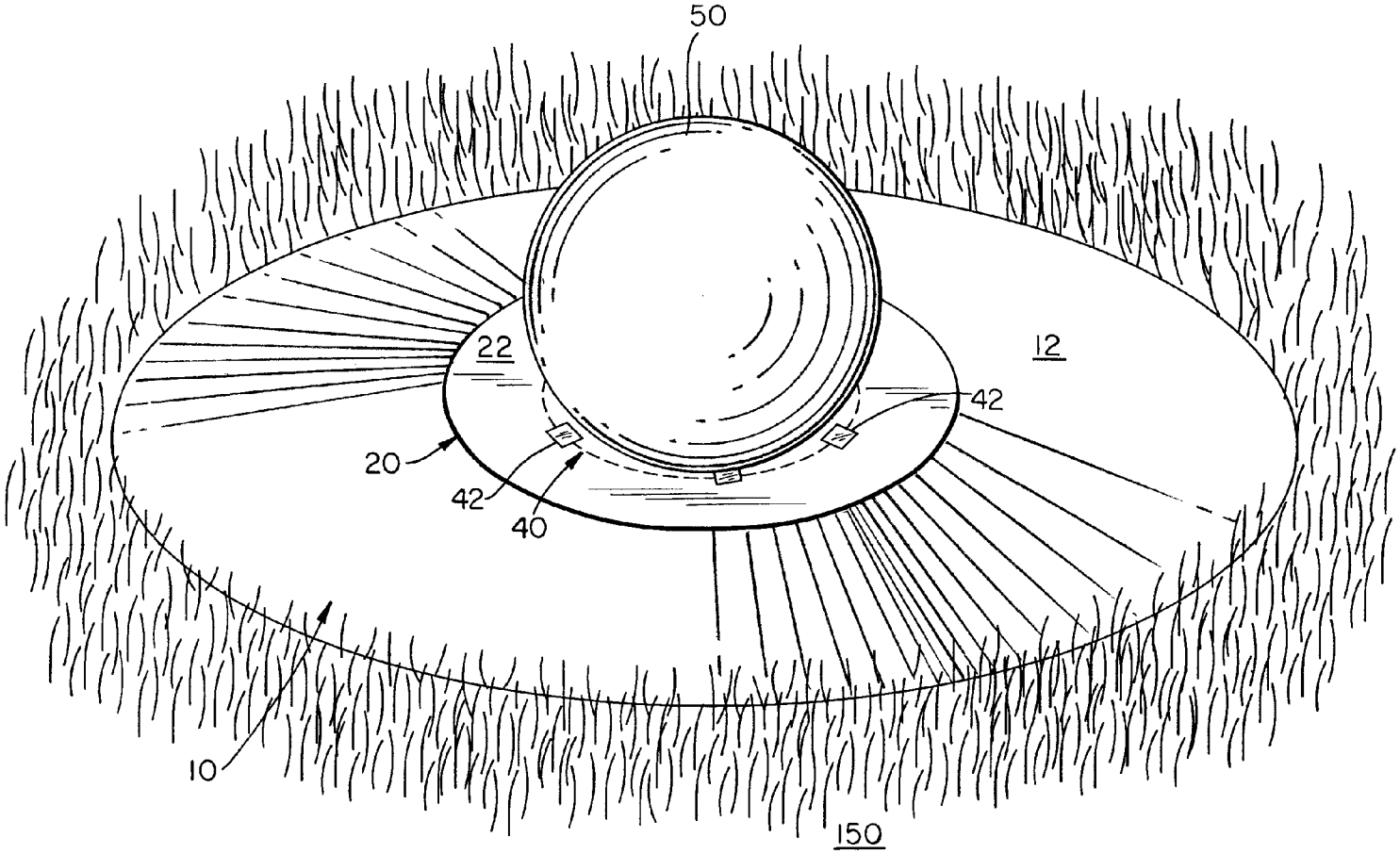
FIG. 2 is a perspective view of the putting training aid of FIG. 1, showing a ball positioned thereon.
Figure 3:
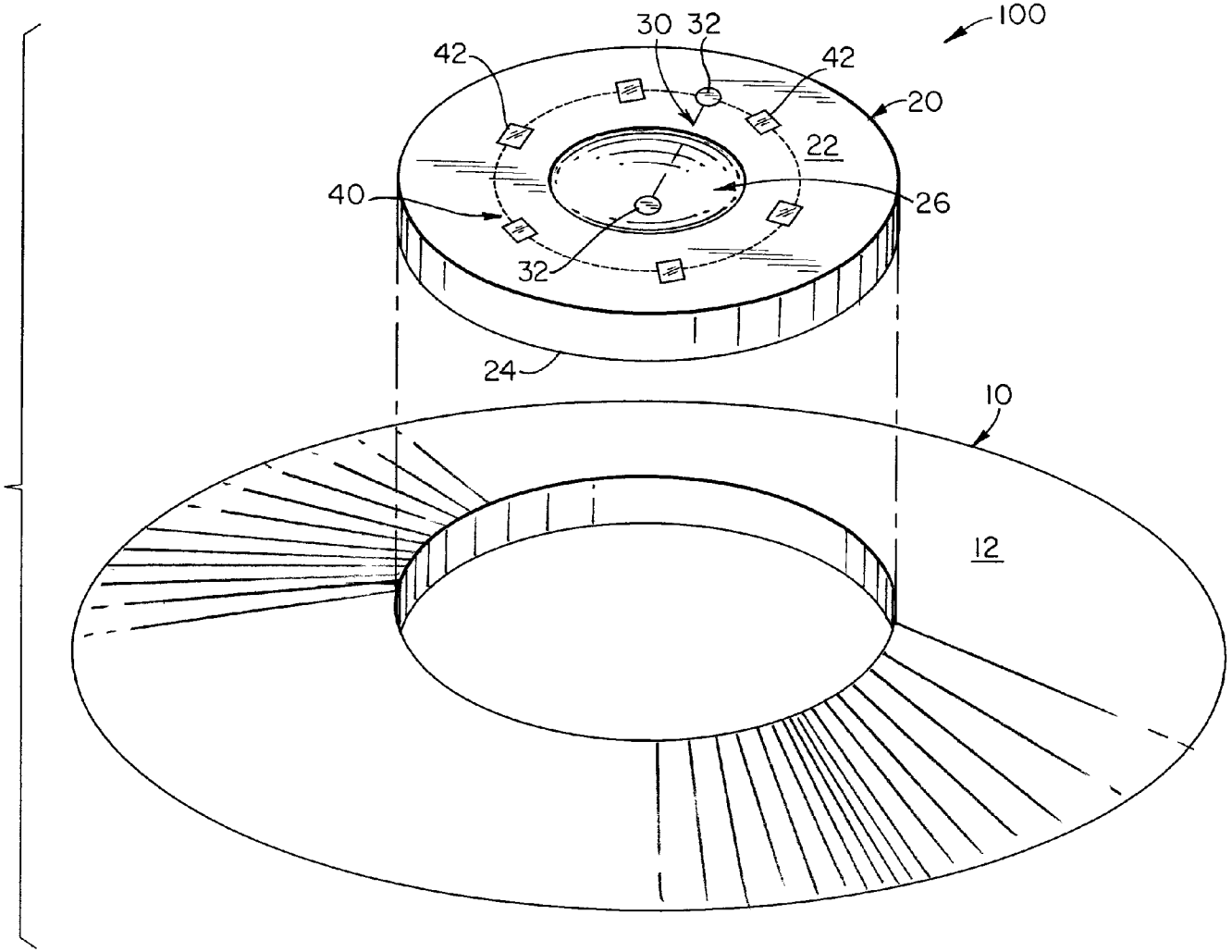
FIG. 3 is a perspective exploded view of the putting training aid of FIG. 1.
Figure 6:
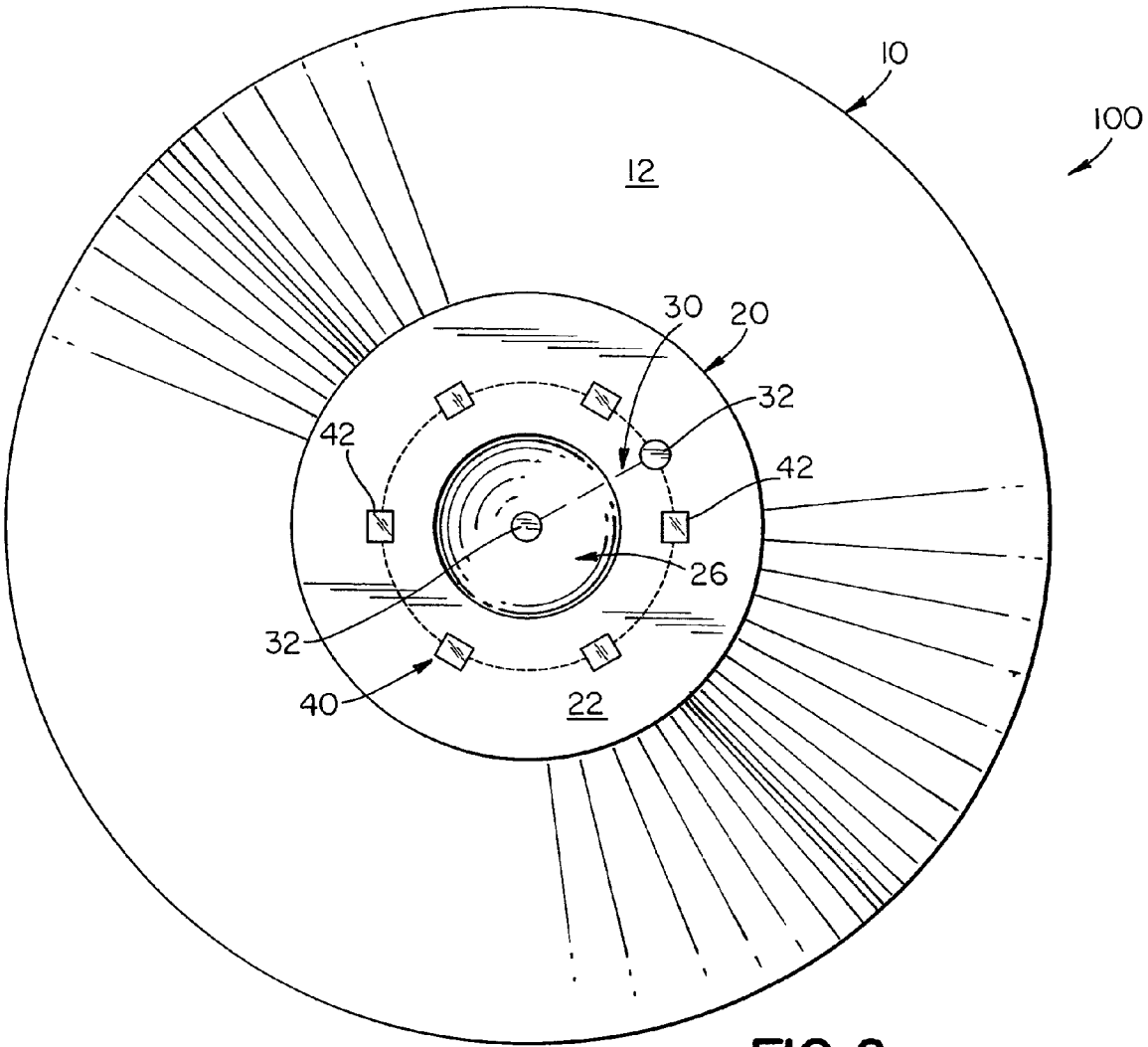
FIG. 6 is a top view of the putting training aid of FIG. 1.

Referring to FIGS. 1-3, the putting trainer 100 may include a ball receiving mount 20 positioned on base 10. The ball receiving mount 20 can be imbedded within the base 10, such that a top surface 22 of the ball receiving mount 20 is flush with top surface 12 of base 10. The mount 20 may extend through base 10, with a bottom surface 24 being visible from the bottom surface 14 of mount 20, as shown in FIG. 6. The mount 20 and the base 10 could be of equal thickness, as best depicted in the cross-section of FIG. 5 and in FIG. 3. In this manner, referring to FIG. 8, the mount 20 would extend entirely through base 10, with bottom surface 24 of mount 20 being flush with bottom surface 14 of base 10. As shown in FIG. 8, bottom surface 24 of mount 20, visible from bottom surface 14 of base 10, may include a power button 28 for the operation of ball positioning sensor 30 and light source 40, explained in more detail herein below.

The base 10 and mount 20 may be constructed of any material, and may in some embodiments, be the same material forming an integrally molded device body. The base 10 is desirably lightweight and flexible, such as a high-grade elastomeric material, or rubber material, which may, in certain embodiments, be clear or translucent. In one embodiment, the mount 20 could be constructed of polycarbonate, which is very durable, while the base 10 is constructed of a flexible elastomeric material. The base 10 may include any dimensions capable of maintaining a ball 50 on its surface until such time that it is impacted and rolled onto a floor or ground surface, such as ground surface 150, shown in FIGS. 1-2. The ground surface 150 could be, for example, a practice putting green. The base 10 should be small enough in size, such that the putting trainer 100 is extremely portable and moveable from one location to another. For example, the base 10 of putting trainer 100 may be circular having between a ten and twelve inch diameter. By being of portable size, the putting trainer 10 may be transported in a user's golf bag and used on a practice green before playing a round of golf.

Referring specifically to FIGS. 1, 3, 5, and 6, the ball receiving mount 20 may include a ball receiving recess 26. The ball receiving recess 26 is designed to allow the ball 50 to stably rest on mount 20 prior to being impacted from the mount 20. During use, the ball receiving recess 26 allows the ball 50 to be impacted from mount 20 and to roll over top surface 22 of mount 20 and top surface 12 of base 10. In this manner, because top surface 22 of mount 20 is flush with top surface 12 of base 10, surface 22 and surface 12 act as a putting surface to transition the ball 50 from the putting trainer 100 to the surrounding environment, such as the ground, floor, or other putting surface, as indicated by the ground 150 in FIGS. 1-2.

Figure 4:
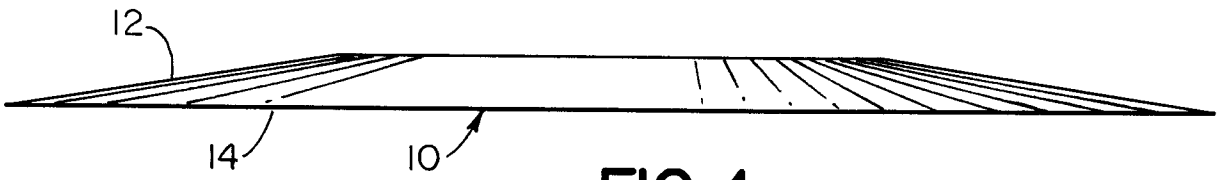
FIG. 4 is a side view of the putting training aid of FIG. 1.
Figure 5:
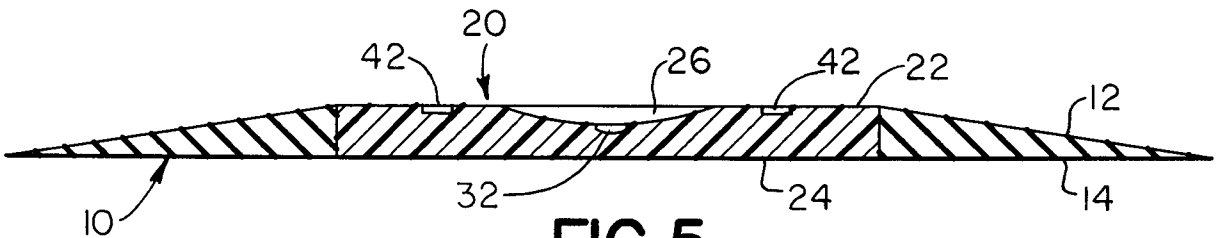
FIG. 5 is a cross-sectional view of the putting training aid of FIG. 1 along line A-A.

The ball positioning sensor 30 may be positioned in the ball mount 20, as illustrated in FIGS. 1, 3, and 4. The ball positioning sensor 30 may be positioned under top surface 22 of mount 20, such that the ball positioning sensor 30 is located beneath ball receiving recess 26. However, it is also contemplated that the sensor 30 could be positioned in the base 10, itself.

The ball receiving mount 20 may also include a light source 40 which is visible from above the top surface 12 of base 10. When the base 10 and/or the mount 20 are constructed of a translucent material, the light source 40 could be contained in or embedded completely within the translucent material. In this manner, the light source 40 would still be visible to the user although it is completely embedded within the base 10 and/or the mount 20. The light source 40 is configured to respond to a signal from the ball positioning sensor 30 that the ball 50 has been impacted from the ball receiving recess 26 of mount 20 by a user putting the ball 50 over surface 12 of base 10. The light source 40 responds to the signal by transmitting visible light, viewable from the top surface 12 of the base 10 for a finite predetermined period of time after the ball 50 is impacted from the ball receiving recess 26 and rolled over the tapered top surface 12. In this manner, a user can maintain focus on the transmitted light for the predetermined period of time, which is explained in more detail below.

The light source 40 may include a plurality of lights 42, such as LED lights. However, the light source 40 may include any element capable of emitting light in a desired pattern or array. As illustrated, the transmission of visible light viewable from above the top surface 12 of base 10 may be accomplished by embedding the lights 42 in mount 20 and arranging them in a pattern, such as circular formation perimetrically around the ball receiving recess 26, thereby establishing a desired pattern or array for light source 40. In certain embodiments, the base 10 and/or mount 20 may be constructed of a clear or translucent material, such that the lights 42 can be completely embedded within the mount 20, i.e., completely covered, yet still be visible to a user through the clear or translucent material.

When the lights 42 are arranged in a circular pattern, the circular pattern may have a diameter that is approximately equal to that of the ball 50, such as that of a golf ball. As best shown in FIG. 7, which is a top view, the lights 42 are not visible from the perspective of a user when ball 50 is placed in ball receiving recess 26, since the diameter of the light formation is equal to that of ball 50. Unlike the device disclosed in U.S. Pat. No. 7,513,833, discussed above, the ball 50 is received over a portion of the device, i.e., ball receiving recess 26, located over at least a portion of the light source 40. This aids a user in focusing on the area, wherein the ball 50 was located after impact so that the user can maintain the correct movement of the hands and golf club down the target line. This is an improvement over U.S. Pat. No. 7,513,833, which discloses use of a non-ball focal point.

As noted above, the light source 40 responds to a signal from the ball positioning sensor 30 to transmit light for a predetermined period of time, after a ball 50 has been impacted from ball receiving recess 26. The ball positioning sensor 30 may include two spaced apart positioning sensors 32*a*, 32*b*, which are in operable communication with each other. Sensors 32*a*, 32*b* will generally be embedded, such that they are capable of detecting the presence or absence of ball 50. For example, sensor 32*a* may be positioned directly beneath ball receiving recess 26, as shown best in FIG. 8. In this manner, positioning sensor 32*a* will be directly beneath the ball 50 when it is placed on mount 20. As shown, the sensors 32*a*, 32*b* are visible from recess 26 and top surface 22, respectively. However, the sensors 32*a*, 32*b* can also be completely embedded within mount 20 underneath surface 22, i.e., completely covered.

Figure 10:
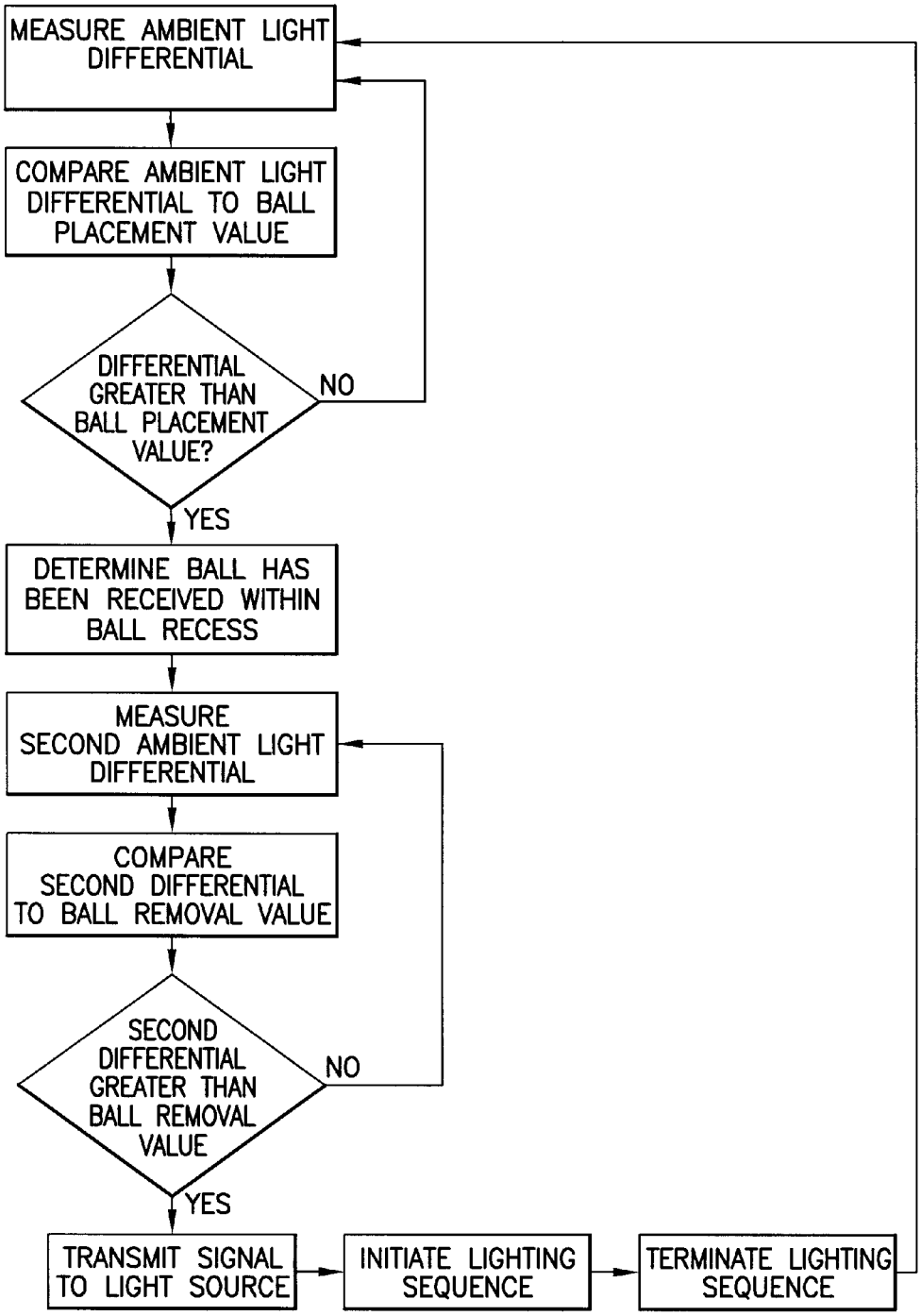
FIG. 10 is a process flow diagram of one embodiment of the operation of the putting training aid of FIG. 1.

One way of accomplishing detection of the presence or absence of ball 50 on the mount 20 is by providing the sensors 32*a*, 32*b* as light sensors that are capable of sensing ambient light. In this manner, the sensors 32*a*, 32*b* can measure light differentials in ambient light between each other. The ambient light can be any external environment light wherein the putting trainer 100 is used, such as room light or sun light. The following description explains this particular embodiment of the operation of the putting training aid. The algorithm of this embodiment is shown and summarized in the process flow diagram of FIG. 10. Prior to ball 50 being placed on ball receiving recess 26, the ball positioning sensor 30 is in a state, wherein it waits for the ball 50 to be placed. In this state, the sensor 30 is measuring the ambient light differential between sensors 32*a* and 32*b*. The ambient light differential between sensors 32*a* and 32*b* is measured and compared to a ball placement value. If the differential is larger than the ball placement value, then the sensor 30 recognizes that the ball 50 has been placed on ball receiving recess 26. At this point, the sensor 30 enters a state in which it is waiting for the ball 50 to be removed from recess 26, i.e., impacted off of putting aid 100 by a user. The ambient light differential between sensors 32*a* and 32*b* is again measured and compared to a ball removal value. When the light differential is larger than the ball removal value, then the sensor 30 recognizes that the ball 50 has been removed from recess 26.

When the light source 40 includes a plurality of lights 42 arranged in a circular pattern, sensors 32*a*, 32*b* may be embedded in mount 20 and positioned on the circumference defined by the circular pattern of lights 42. Sensor 32*b* is illustrated as being positioned on this circumference. In this manner, the ambient light differentials are the differences in light measured directly beneath the ball 50 in ball receiving recess 26 and the light measured at the perimeter of the circular pattern of light source 40.

After the sensors 32*a*, 32*b* measure the ambient light differential to determine that the ball 50 has been impacted from recess 26, the sensor 30 enters a third state. In this state, it transmits a signal to the light source 40, wherein light source 40 responds by initiating a lighting sequence for a predetermined period of time. That lighting sequence may be a series of light flashes emitting from lights 42. For example, after the ball 50 is impacted from ball receiving recess 26, the lights 42 may flash for three times over a predetermined period of time. The number of flashes and the period of time may vary. The time and number of flashes should be sufficient to allow a user to maintain focus on the light source 40 to ensure an accurate putt. The lighting sequence may, for example, range between 1-5 flashes over a period of approximately 1-3 seconds, and preferably 1.5 seconds.

After the lighting sequence is terminated, the sensor 30 returns to its original state, wherein it waits to detect a light differential corresponding to the ball 50 being placed on recess 26.

Optionally, the ball positioning sensor 30 may also be capable of sensing the amount of ambient light in the external environment and vary the amount of light transmitted from light source 40 according to the available ambient light. In this manner, the light from light source 40 will always be transmitted to the degree required for optimal visual perception.

Figure 9:
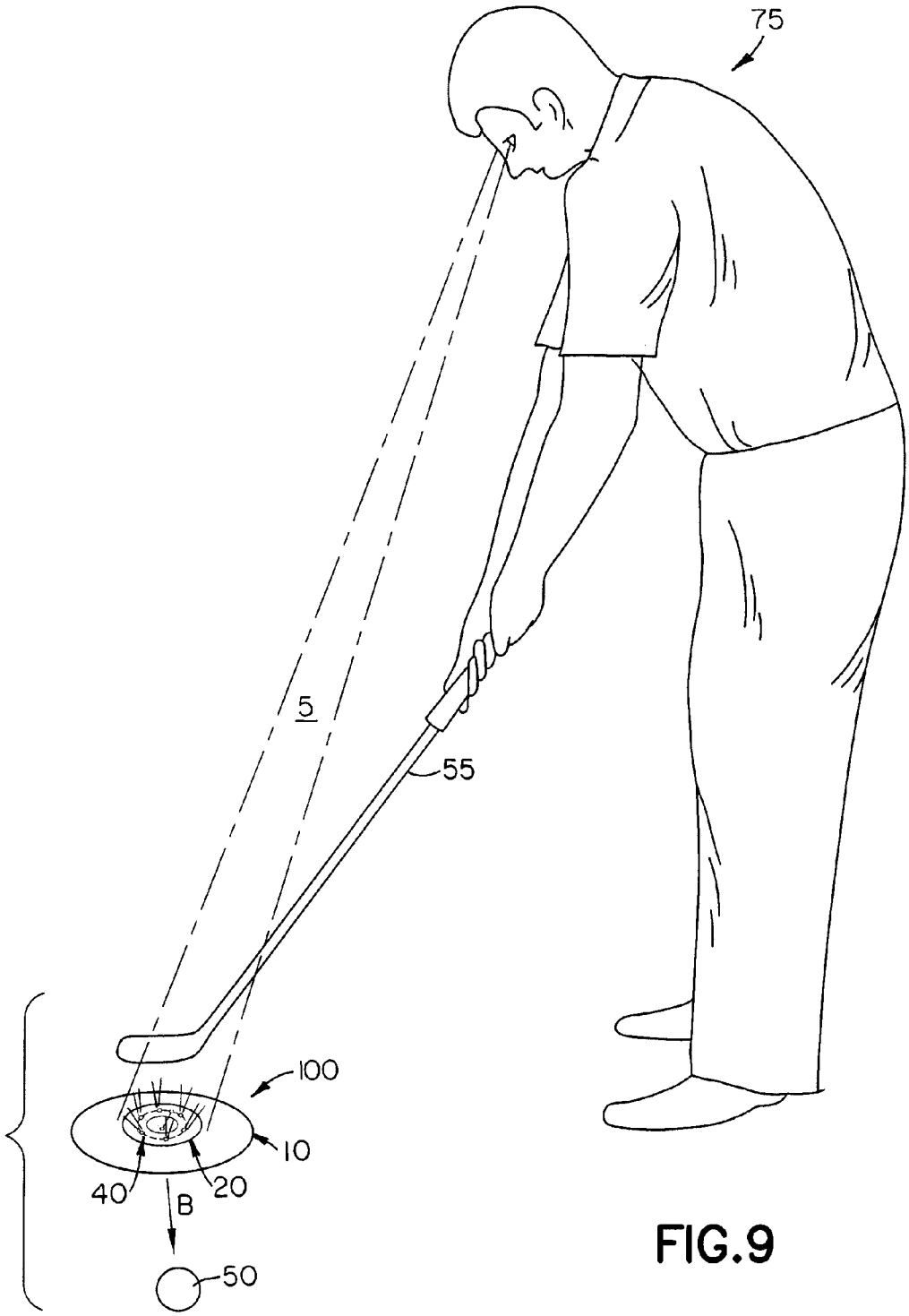
FIG. 9 is a view of the putting training aid of FIG. 1 in use.

Referring to FIG. 9, a user 75 with a putter 55 is shown using the putting trainer 100. In use, a ball 50 will placed in ball receiving recess 26 by a user. At this point, the ball positioning sensor 30 will detect the presence of the ball 50. The user can then begin a putting stroke to strike the ball 50 to roll over tapered top surface 12 to a putting surface away from putting trainer 100 toward a target, such as a golf hole, as indicated by arrow B. As shown in FIG. 9, after the ball 50 has been impacted from the putting trainer 100, the lights 42 will illuminate, initiating a lighting sequence. This lighting sequence, as explained above, is due to the ball positioning sensor 30 determining that the ball 50 is no longer located in ball receiving recess 26. The user can then focus on the lights 42 for the duration of the lighting sequence, as illustrated by line of site S, thereby keeping his or her head down for the entire period in which the light is visible from light source 40, for example, 1.5 seconds. This is unlike the device disclosed U.S. Pat. No. 7,513,833, which only discloses flashing a colored light after impact for fractions of a second. The user's focus is aided by the fact that the lights 42 may be arranged to define a light source 40 having substantially the same diameter as the ball 50. Upon termination of the lighting sequence, the golfer may then pick up his or her head to see the direction of the ball 50. On short putts, the time period of the lighting sequence may exceed the amount of time necessary for the ball 50 to reach the target or hole, in which case the user may "listen" to the ball drop.

A new ball may then be placed on ball receiving recess 26, wherein the previously explained steps may then be repeated. The tapering of surface 12 of base 10 aids in this manner because a new ball may simply be rolled up surface 12 from ground 150 by a user's putter.

Figure 11:
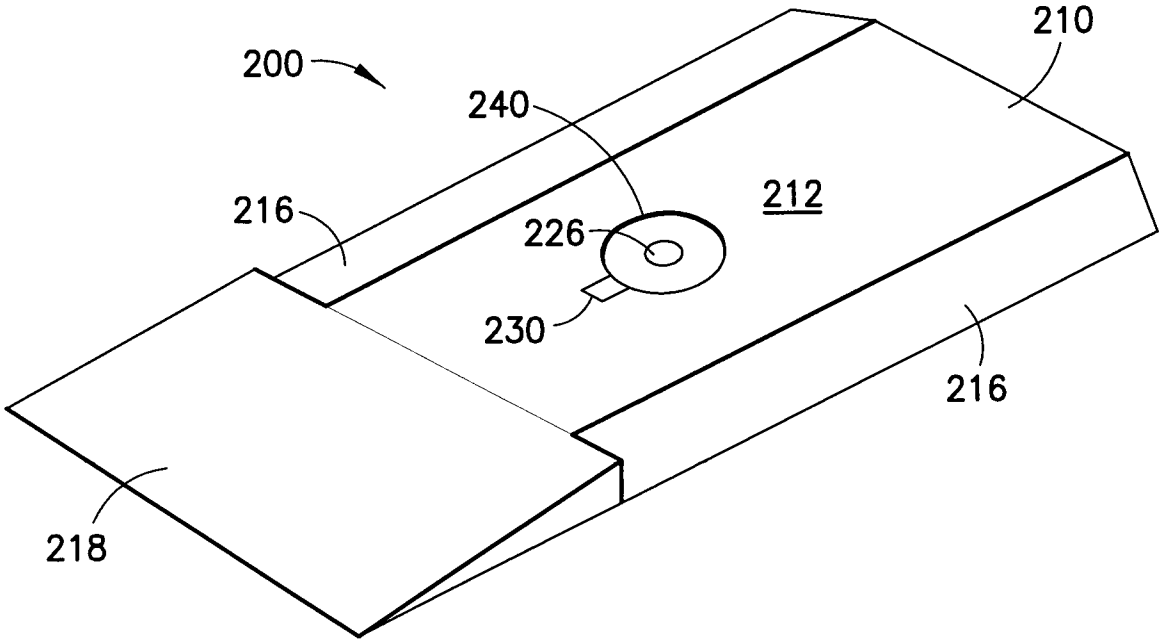
FIG. 11 is a view of another embodiment of a putting training aid according to the present invention.

Lastly, referring to FIG. 11, an alternative embodiment of a putting training aid 200 is depicted. The putting training aid 200 includes a base 210 having a top surface 212, a ball positioning sensor 230, and a light source 240 surrounding a ball receiving recess 226. This base 210 is shaped in a substantially rectangular form, wherein, at least a portion of the top surface 212 is tapered, i.e., tapered portions 216, 218, for putting a ball 50 from ball receiving recess 226 to a putting surface, or for rolling a ball up one of the tapered portions 216, 218 to place a ball on ball receiving recess 226. The ball receiving recess 226 is defined in the top surface 212. Also, the light source 240 and sensor 230 are positioned in base 210, as opposed to being positioned in a mount which is separately embedded within the base. The sensor 230 and light source 240 are positioned adjacent to the recess 226. The operation of putting trainer aid 200 is substantially the same manner as described above, with respect to putting training aid 100, with the exception of the physical differences described above.

The above-described invention is a vast improvement over the prior art, particularly U.S. Pat. Nos. 7,169,067 and 7,513,833. The devices disclosed in those patents teach hand-eye coordination to impact an object, i.e., "keeping your eye on the ball." This is unlike the above-described putting training aid which trains a user to maintain a down head position and keep eyes focused on the exact starting position of the ball after impacting the ball from that position. It requires a user to keep his or her head down for an exaggerated or extended period of time after every putt because the user is not to look up until after the lighting sequence is terminated. This principle is fundamental for accurate and consistent putting.

While the present invention has been set forth in terms of specific embodiments thereof, it will be understood in view of the instant disclosure that numerous variations upon the invention are now enabled yet reside within the scope of the invention. Those skilled in the art may make modifications and alterations without departing from the scope and spirit of the invention. Accordingly, the above detailed description is intended to be illustrative rather than restrictive.

The invention claimed is:

1. A golf training device comprising:

a base having a top surface and an opposing bottom surface for placing on a surface;

a ball positioning sensor positioned adjacent to the top surface; and a light source for transmitting visible light from the base, the light source being in operable communication with the ball positioning sensor to respond to a signal from the ball positioning sensor that a ball has been moved from a resting position to transmit light for a finite predetermined period of time after the ball is moved from the resting position.

2. The golf training device of claim 1, wherein the top surface comprises a ball receiving portion, wherein the ball positioning sensor is positioned adjacent to the ball receiving portion, and wherein the light source responds to a signal from the ball positioning sensor that the ball has been moved from the ball receiving portion to transmit the light for a finite predetermined period of time after the ball is moved from the resting position.

3. The golf training device of claim 2, wherein the ball receiving portion defines a ball receiving recess.

4. The golf training device of claim 1, wherein the light source comprises a plurality of lights.

5. The golf training device of claim 1, wherein the light source is adapted to transmit visible light in a pattern corresponding to the resting position of the ball.

6. The golf training device of claim 5, wherein the light source is adapted to transmit visible light in pattern around the ball.

7. The golf training device of claim 6, wherein the light source is arranged in a circular pattern.

8. The golf training device of claim 7, wherein the circular pattern defines a diameter, such that when a ball is received within the ball receiving recess, the light source is not visible from the user's perspective.

9. The golf training device of claim 2, wherein the light source is arranged around the ball receiving portion.

10. The golf training device of claim 1, wherein at least a portion of the top surface is tapered to the surface, such that when the ball is moved from the resting position, the ball transitions from the tapered portion to the surface.

11. The golf training device of claim 1, wherein the transmission of light from the light source for a finite predetermined period of time comprises a series of flashes.

12. The golf training device of claim 1, wherein the light source transmits light from the top portion of the base.

13. A method of training comprising the steps of:

receiving a ball on a top surface of a training device in a resting position;

detecting the presence of the ball on the top surface of the training device;

detecting that the ball has been moved from the resting position;

transmitting light from a light source visible from the training device for a predetermined period of time in response to detecting that the ball has been moved from the resting position; and ceasing to transmit light after the predetermined period of time has lapsed.

14. The method of claim 13, wherein the steps of detecting comprising detecting via a ball positioning sensor.

15. The method of claim 13, wherein the step of transmitting light comprises initiating a series of light flashes for the predetermined period of time.

16. The method of claim 13, further comprising the steps of:

a user impacting the ball from the resting position to move the ball from the resting position, and the user maintaining focus on the transmitted light for the predetermined period of time.

17. The method of claim 13, wherein the step of transmitting light from the light source comprises transmitting light in a pattern corresponding to the resting position of the ball.

18. The method of claim 17, wherein the light is transmitted around the ball.

19. The method of claim 18, wherein the light is transmitted in a circular pattern.

20. The method of claim 14, wherein the step of transmitting light comprising transmitting light from a light source visible from the top surface of the training device for a predetermined period of time in response to detecting that the ball has been moved from the resting position.

* * * * *